US007152350B2

(12) United States Patent
Youngdahl

(10) Patent No.: US 7,152,350 B2
(45) Date of Patent: Dec. 26, 2006

(54) GREETING CARD DEVICE

(76) Inventor: Jennifer Youngdahl, 249 Eldridge Ave., Mill Valley, CA (US) 94941

( * ) Notice: Subject to any disclaimer, the term of this patent is extended or adjusted under 35 U.S.C. 154(b) by 67 days.

(21) Appl. No.: 10/971,058

(22) Filed: Oct. 25, 2004

(65) Prior Publication Data

US 2005/0102867 A1 May 19, 2005

Related U.S. Application Data

(62) Division of application No. 10/400,030, filed on Mar. 26, 2003, now abandoned.

(60) Provisional application No. 60/367,963, filed on Mar. 26, 2002.

(51) Int. Cl.
*G09F 1/00* (2006.01)

(52) U.S. Cl. ..... 40/124.06; 40/124.03; 40/124.01; 369/273

(58) Field of Classification Search ..... 40/124.03, 40/124.06, 124.01; 235/487; 369/272.1, 369/273

See application file for complete search history.

(56) References Cited

U.S. PATENT DOCUMENTS 5,915,734 A * 6/1999 Minehart ..... 283/117
6,453,300 B1 * 9/2002 Simpson ..... 705/26
2002/0118948 A1 * 8/2002 Jones ..... 386/46

FOREIGN PATENT DOCUMENTS

| | | | |
|---|---|---|---|
| GB | 2 275 891 | * | 9/1994 |
| GB | 2 360 736 | * | 3/2001 |
| WO | WO 02/36355 | * | 5/2002 |

* cited by examiner

*Primary Examiner*—Mark T. Le
(74) *Attorney, Agent, or Firm*—Jagtiani + Guttag

(57) ABSTRACT

A system is designed for highly customizing and personalizing a greeting card through the association with a digital recording media. The CD can include a writable track for recording the user's voice input and a writable track for recording other audio and/or video input. The CD can, additionally be provided with a track prerecorded with words and music based around specific occasions, such as Mother's Day, Christmas, etc. and can be provided with a track on which is prerecorded instrumental music for use karaoke style. As a further option, the CD can be provided with a writable track for recording the user's voice merged with the music on the instrumental track.

15 Claims, 5 Drawing Sheets

GREETING CARD DEVICE

FIELD OF THE INVENTION

The invention relates to a multi-media greeting card.

SUMMARY OF THE INVENTION

The present invention relates to a system for highly customizing and personalizing a greeting card. The greeting card is employed in association with a digital recording media, preferably a CD, although other recordable media can be used such as Smart Media, Compact Flash, IBM microdrive, or any future developed digital recording media. The term CD is intended to include optical media in general, include DVD or other optical media.

The CD can include a writable track for recording the user's voice input and a writable track for recording other audio and/or video input. The video input can be digital still pictures or video. Analog video and audio can also be stored on recordable tracks. Additionally, while reference is made to tracks, it is understood that some media do not employ tracks in the sense that CDs have physical track regions. Thus, the term track should be understood as being used broadly to indicate memory regions, irrespectively of the actual physical arrangement of the memory regions. The CD can, additionally be provided with a track prerecorded with words and music based around specific occasions, such as Mother's Day, Christmas, etc. The CD can be provided with a track on which is prerecorded instrumental music for use karaoke style. As a further option, the CD can be provided with a writable track for recording the user's voice merged with the music on the instrumental track. The system can include any combination of the foregoing and need not include all of the foregoing options.

DESCRIPTION OF THE PREFERRED EMBODIMENTS OF THE INVENTION

The greeting card of the present invention combines the functionality of conventional greeting cards with new functions that transform the greeting card into an interactive media.

The cards are applicable for celebrating an anniversary, birthday, Mother's Day, birth, expressing a Thank you or Get Well wish. Other standard events such as graduation, bar mitzvah, and the like are equally applicable and the interactive nature of the novel greeting card enables the sender to customize the card to a special event. The greeting card of the present invention brings together the music, personal growth and greeting card markets in one product and is an affordable new alternative to buying a gift and a card, or a CD and a card. The picture provided on the card can be of a quality that is suitable for framing.

In one embodiment, the card system employs a writable CD. In other embodiments, the writable digital media can be other media such as solid state memory cards sold as Smart Media, Compact Flash cards, Sony memory sticks or the like. While any ubiquitous media can be used, at this time, CDs are a commonplace media and currently computers are commonly sold with CD writers. While DVD and other high capacity media can be used, the high capacity does not provide an advantage for most situations in which greeting cards are used.

An advantage of the multimedia greeting card over standard paper or digital cards is that it can include songs of encouragement, songs for the grieving process, songs for recovery, inspiration, celebrating patriotism or can facilitate meditation or religious practices.

The greeting cards can be sold in large retail stores such as Target and Wal-Mart, as well as boutique and specialty stores and on cable sales channels, such as HSN. The consumer is attracted to the highly attractive cards with a CD inside that perfectly expresses what they would like to say from their heart.

Figure 4:
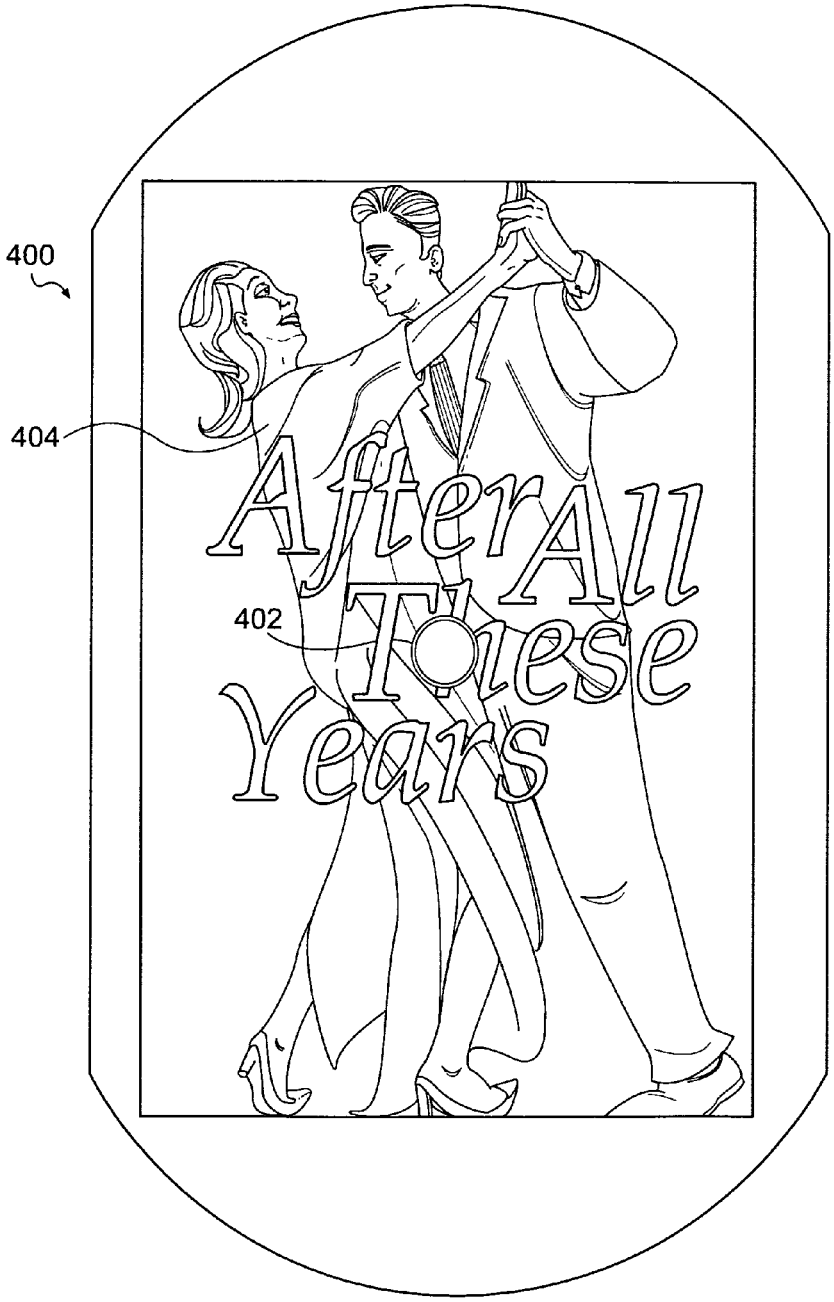
FIG. 4 is an illustration of an alternative type of CD having an illustration on the unrecorded surface.
Figure 5:
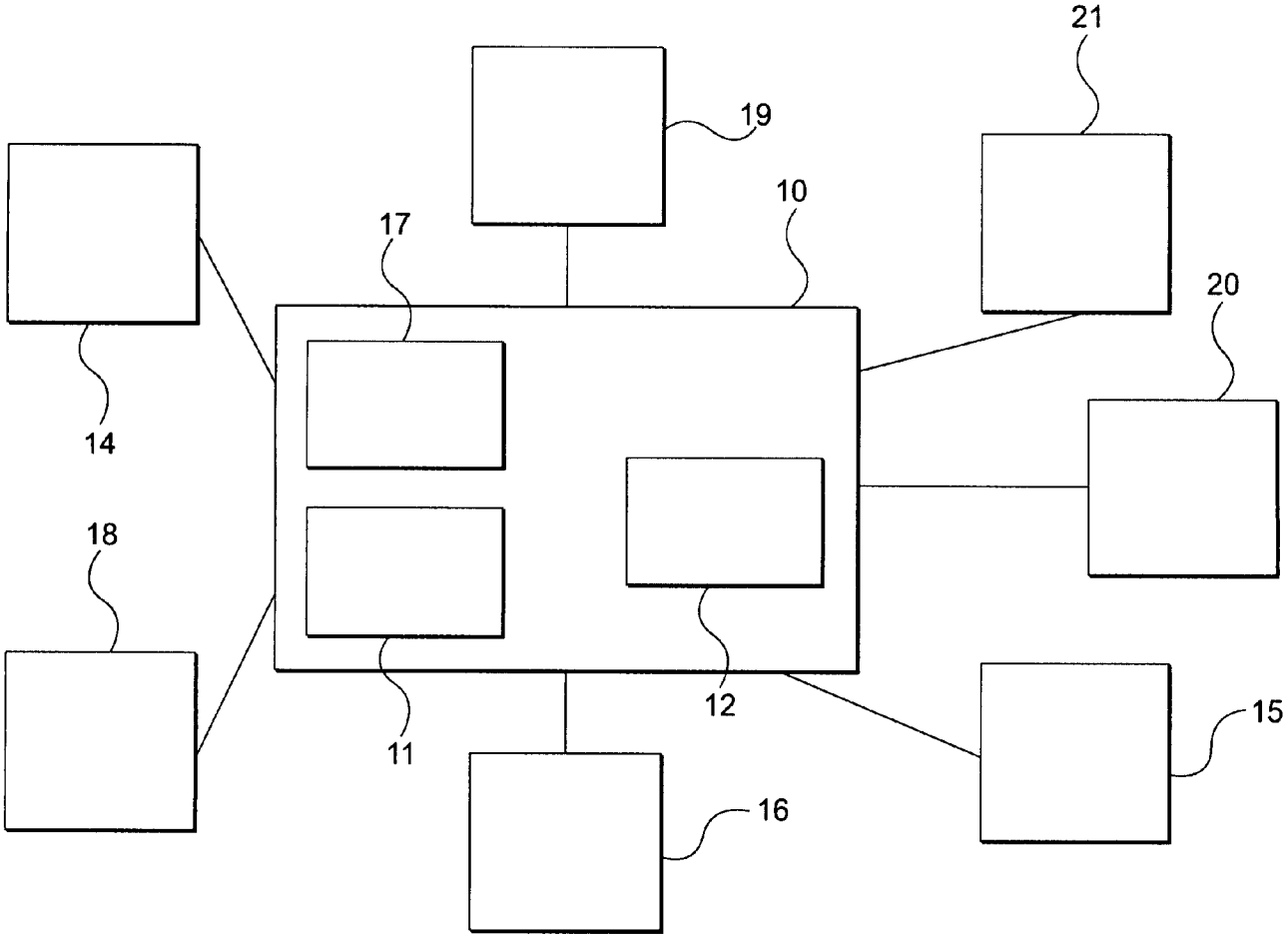
FIG. 5 is a schematic illustration of hardware components used in creating a greeting card of the present invention.

In one embodiment of the invention, there is a kiosk that is an MP3 sound station where the consumer can demo the songs that come tucked inside the cards on CD. While reference is made to MP3 compression, the system can employ uncompressed audio and/or video and can employ other compression systems, such as MP3Pro and WMA. Where the CD is a business card, as illustrated in FIG. 4, the use of a compression algorithm can be used to maximize the amount of data that can be stored on the CD. The kiosk can be provided with a microphone, preferably in a sound booth, in order to enable the user to input an audio message to the CD, thereby personalizing the CD.

A customer, who wishes to add words to the instrumental track, provided on the CD, could read a poem, sing a song or simply speak at random. The system 10 can integrate the customer's voice with the instrumental track to provide a customized, merged combination of prerecorded music and customer voice. The kiosk can be provided with an audio headset 15 for the customer to listen to the prerecorded instrumental track while inputting the customized voice message.

In smaller stores where space is an issue, a small, or portable type of CD player can be mounted into a rack for demo song collections on CD.

Figure 1:
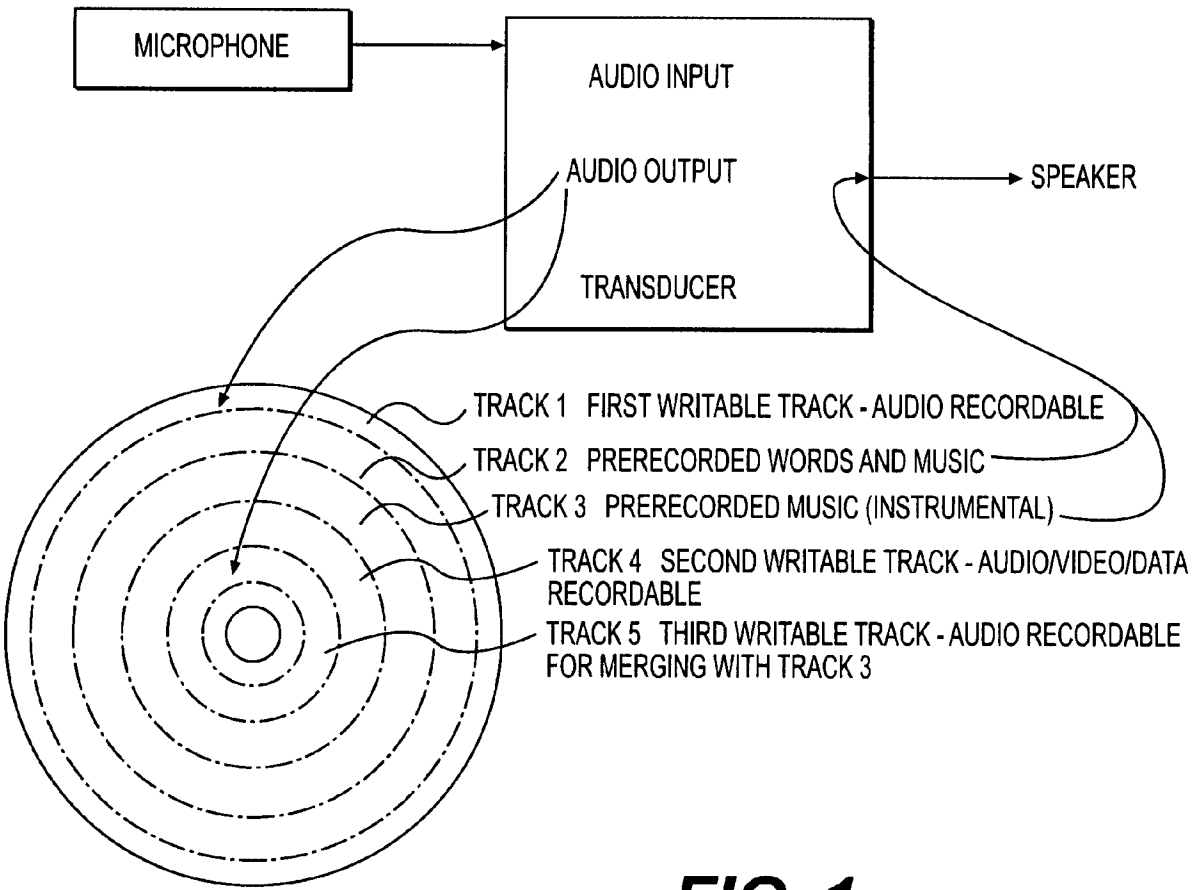
FIG. 1 is a schematic illustration of the system of the present invention.

Looking now to FIG. 1, the system can include a CD, a CD read/writer, and a transducer for converting audio input to digital data that is recordable on a CD and for generating an audio output to speakers 16. The transducer can be a desktop computer 10 or the like with an internal or external CD read/write mechanism 17. The transducer can, alternatively, be a computer mechanism housed within a kiosk.

Figure 2:
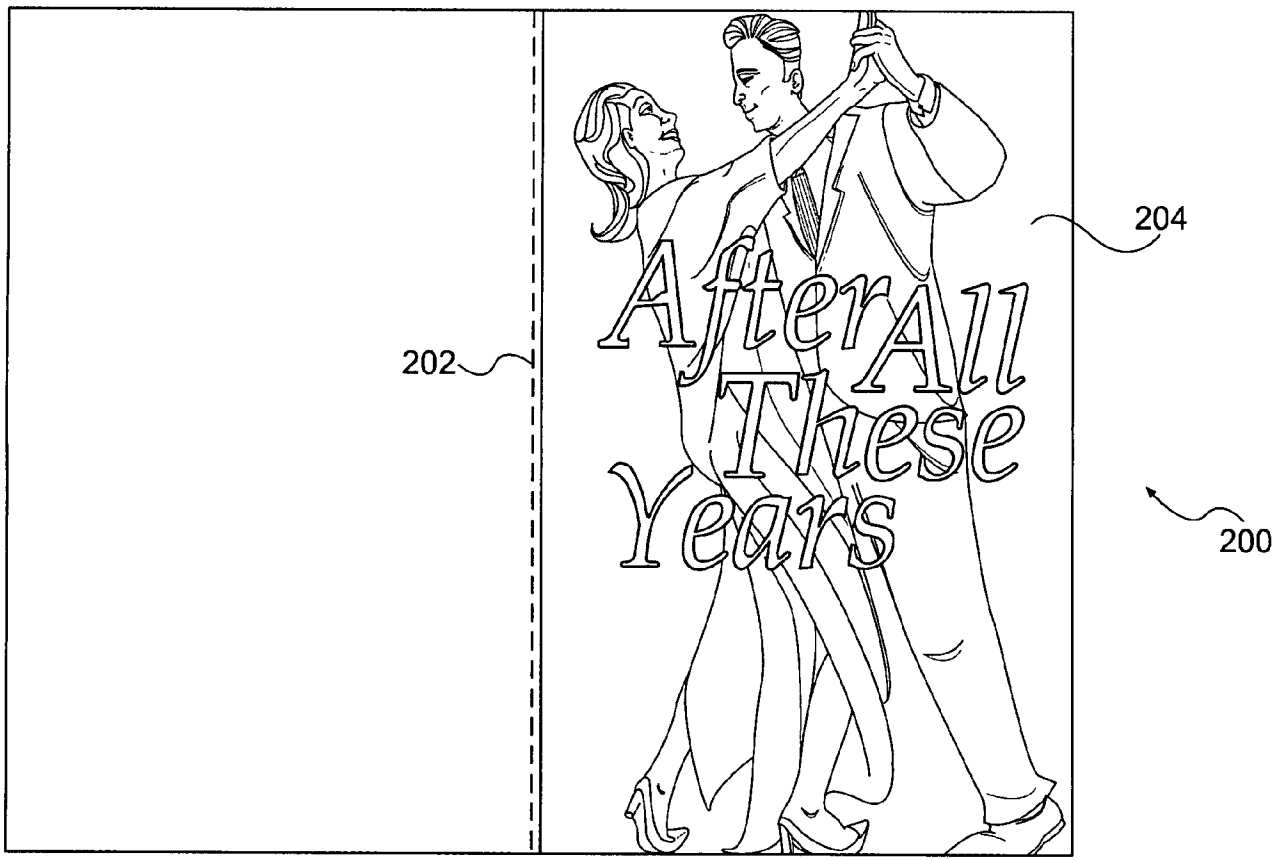
FIG. 2 is an illustration of the front illustration and back sheet of a greeting card of the present invention.

FIG. 2 shows the high quality picture 204 on the face side of the card indicated generally as 200. The card is folded along fold line 202, as well known in the art.

Figure 3:
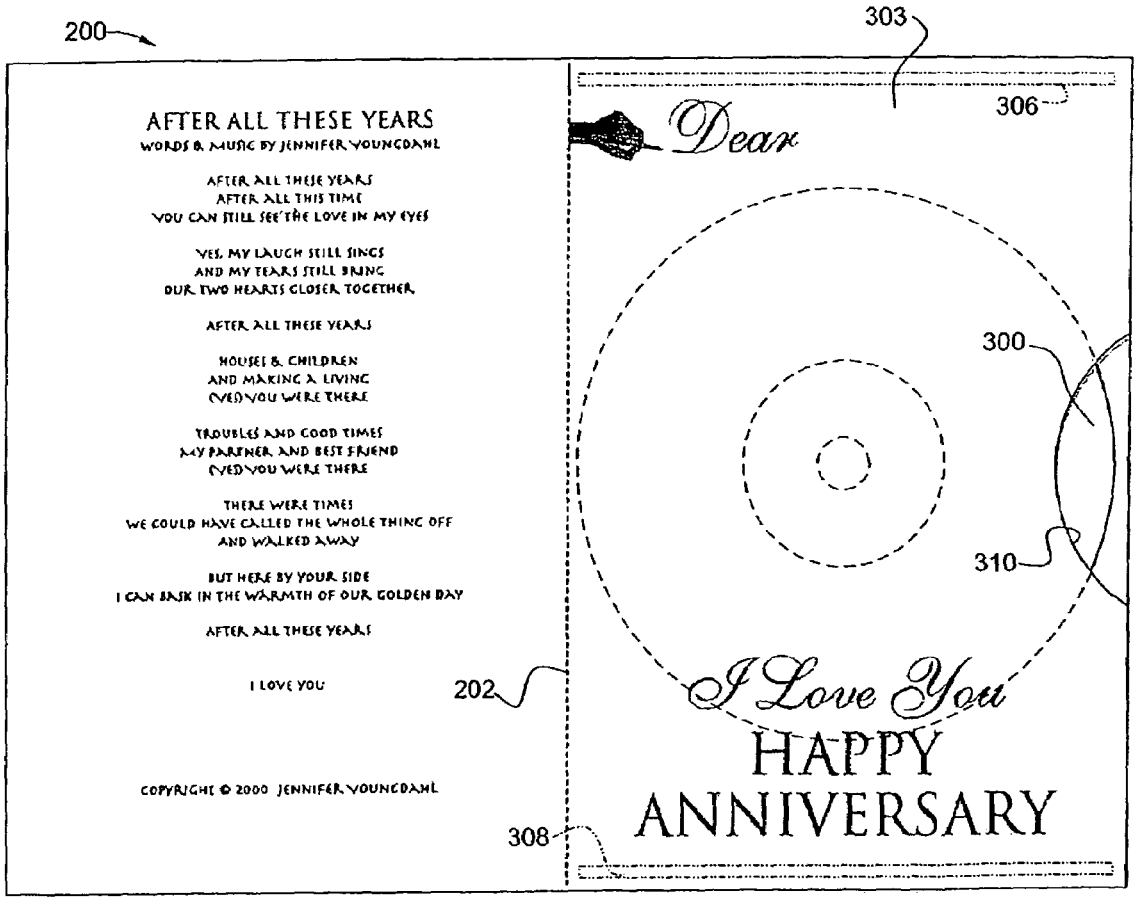
FIG. 3 is an illustration of the inside two sheets of a greeting card of the present invention showing a sleeve for receiving a CD.

FIG. 3 is an illustrated example of the interior faces of the card 200. In this illustration, the text information is provided on the left sheet and the right sheet is modified to accommodate a CD 300. Obviously, the reverse is also applicable. The CD sleeve 303 can be formed in any convenient manner, as for example, by gluing a compatible sheet to the face sheet. The gluing 306 and 308 can along the top and bottom of the rear inside of the card. The card is thus double-layered, and the CD slips into the "slot" that is formed between the two glued sheets. A semi-circle or other convenient shape cut away region 310 can be die-cut so that part of the CD surface shows thus enabling it to be removed from the slot.

FIG. 4 is a plan view of an alternate type of CD, commonly referred to as a business card CD, and identified generally as 400. The face or unrecorded side of the CD can be provided with the picture 404, corresponding to the picture on the face of the greeting card. The center spindle hole of the CD is identified as 402.

EXAMPLE I

The customer selects a greeting card and brings it to a kiosk provided at the store. The kiosk includes a CD read-write mechanism 17. It should be noted that the computation capabilities of the kiosk computer 10 is very low end and employ very low end or even obsolete computer technology. For convenience, a touch screen, or other easy method of entry, should be provided for easy of entry of commands by the consumer. The touch screen 20 provides the benefit of being easy to use as well as being easily visible, enabling young children, as well as those having visual difficulties. A touch screen further provides the advantage that the indicators on the screen can be symbolic, thereby permitting users not versed in the written language to create cards. The software provided guides the consumer through the various steps of the process and can provide guidance, help information and suggestions.

The customer plays the music track (e.g. track 2 of FIG. 1) and confirms that the card purchase is to be made. The customer then uses the condenser, or other applicable type, microphone provided at the kiosk and reads a prepared message or a personal message into memory 12 while speaking into the microphone. The customer can then listen to the personal message and either rerecord the message or activate the system to record the personal message on a recordable track (e.g. track 1 of FIG. 1). In this embodiment, the message does not overlay the music.

The system within the kiosk, either within the computer or on the CD, can store a large selection of prerecorded music, or can provide the customer with the option of selecting, and in some embodiments downloading on to the computer from a separate source, a preferred musical score for use in conjunction with the greeting card.

The customer can employ a scanner 18 provided at the kiosk and scan photographs, documents, memorabilia, or the like into the system. The scanned images are then stored on the CD on a separate recordable track (e.g. track 4 of FIG. 1). Where the greeting card is a thank you card for an event such as a wedding, wedding shower, baby shower or other event that involves the gathering of people, the writable track 5 can include digital photographs taken at the event. Thus, attendees of the event can be provided with a thank you card, a verbal thank you and photographs of the event. The kiosk can be provided with a digital data input, such as a CD read drive, a floppy drive, a solid-state memory card or any other convenient mechanism for inputting digital information to the CD.

The customer can also be provided with the option to print a scanned or downloaded image on the face side or interior of the card or, in some embodiments, onto the face of the CD, thus further personalizing the greeting card.

The customer can listen to a prerecorded instrumental track (such as track 3 of FIG. 1) while speaking or singing into the microphone 14. The customer can then listen to the recording and accept it or reject it. If the recording is accepted, the system 11 merges the prerecorded instrumental music and the customer's audio input into a recordable track, (such as track 5 of FIG. 1). It should be understood that any combination of the foregoing options can be employed and less than all options can be selected or provided to the customer.

The recipient of the greeting card can frame the picture and can play any selected track. The recipient can use, for example, a personal computer, add their own additional data, memorabilia, data, or the like, to a recordable-track, (such as track 4 of FIG. 1). Additionally, the recipient can use the CD to store digital photographs of the event that is associated with the card.

EXAMPLE II

The customer selects a greeting card at the store and brings it to a CD read-write mechanism provided at the store. The unit can be a desktop computer, a portable (laptop) computer or a CD player, preferably having write capabilities. It should be noted that the computation capabilities required by the computer is very low end, therefore enabling the store to use very low end or even obsolete computers. Where a computer is provided, the computer is provided with software that guides the customer through the various steps of the process. The customer plays the music track (e.g. track 2 of FIG. 1) and confirms that the card purchase is to be made. The customer then uses the built in microphone 14, such as a condenser microphone, provided at the store and reads a prepared message or a personal message while speaking into the microphone. The customer can listen to the personal message and either rerecord (rewrite) a message or activate the system to record the personal message on a recordable track (e.g. track 1 of FIG. 1).

The recipient of the greeting card can frame the picture and can play any selected track. The recipient can use, for example, a personal computer, add additional data, memorabilia, data, or the like, to a recordable track, (such as track 4 of FIG. 1). Additionally, the recipient can use the CD to store digital photographs of the event that is associated with the card.

EXAMPLE III

In many instances, the customer will have a personal computer with a CD burner capable of reading and writing CDs. The customer selects a greeting card at the store, plays the music track (e.g. track 2 of FIG. 1) and confirms that the card purchase is to be made. The customer then brings the card home. The CD includes software for guiding the customer through the process of customizing the CD greeting card. The software provided on the CD guides the consumer through the various steps of the process and can provide guidance, help information and suggestions. Alternatively, or additionally, the customer can link to a web site that provides a large selection of music, poetry and the like as well as a help system to assist the customer in the creation of a customized greeting card. The music can then be added to the CD by downloading from the website 19.

The customer then uses the computer microphone 14 and reads a prepared message or a personal message while speaking into the microphone. The customer can listen to the personal message and either rerecord a message or activate the system to record the personal message on a recordable track (e.g. track 1 of FIG. 1).

In instances where the customer has a scanner 18 hooked to the personal computer, they can scan photographs, documents, memorabilia, or the like for recording on the greeting card CD at home. The scanned images are then stored on the CD on a recordable track (e.g. track 4 of FIG. 1). Where the greeting card is a thank you card for an event such as a wedding, wedding shower, baby shower or other event that involves the gathering of people, the writable track 4 can include digital photographs taken at the event. Thus, attendees of the event can be provided with a thank you card and with photographs of the event. The customer can also be provided with the option to print a scanned image on the face side or interior of the card, thus further personalizing the greeting card, provided the customer has a color printer 21 of sufficient printing capabilities.

The customer can listen to a prerecorded instrumental track (such as track 3 of FIG. 1) while speaking or singing into the microphone. The customer can then listen to the recording and accept it or reject it. If the recording is accepted, the software provided by the website or on the CD can merge the prerecorded instrumental music and the customer's audio input into a recordable track, (such as track 5 of FIG. 1).

It should be understood that any combination of the foregoing options can be employed and less than all options can be selected or provided to the customer.

As previously noted, the recipient of the greeting card can frame the picture and can play any selected track. The recipient can use, for example, a personal computer, add additional data, memorabilia, data, or the like, to a recordable track, (such as track 4 of FIG. 1). Additionally, the recipient can use the CD to store digital photographs of the event that is associated with the card.

What is claimed is:

1. The method of creating a personalized greeting card comprising the steps of:

a. selecting a digital recording medium, said digital recording medium having prerecorded music on at least one track, b. selecting an appropriate card from a group of cards having a width and a height, said width being greater than the width of said digital recording medium, c. entering digital data into a digital recording device having a processor and data storage, d. storing said digital data in said data storage, e. transferring said digital data from said data storage onto said digital recording medium, and f. storing said digital recording medium in a digital recording medium storage sleeve in said card.

2. The method of claim 1 wherein said digital data is a voice message.

3. The method of claim 2 further comprising the step of playing said prerecorded music while recording said voice message.

4. The method of claim 2 further comprising the step of merging said voice message with said prerecorded music to enable a listener to hear said voice message and said music simultaneously.

5. The method of claim 1 wherein said digital data further comprises visual data.

6. The method of claim 5 further comprising the step of merging said visual data with said prerecorded music to enable a viewer to see said visual data and hear said music simultaneously.

7. The method of claim 6 further comprising the step of merging said voice message with said prerecorded music to enable a listener to simultaneously hear said voice message and said music and see said visual data.

8. The method of claim 2 further comprising the steps of listening to said voice message and then saving the listened to voice message to said digital medium.

9. The method of claim 1 wherein said digital device is a computer.

10. The method of claim 5 further comprising the step of viewing said visual data prior to downloading.

11. The method of claim 1, further comprising the steps of linking to an Internet website, listening to a plurality of prerecorded musical selections, selecting a musical selection, and downloading the selected musical selection and recording said selected musical selection on said digital medium.

12. The method of claim 1 wherein said digital data is a voice message and further comprising the step of merging said voice message with said prerecorded music to enable a listener to hear said voice message and said music simultaneously.

13. The method of creating a personalized greeting card comprising the steps of:

a. selecting an appropriate card, b. selecting a digital recording medium, from a group of digital recording media, each of said digital recording medium having prerecorded music on at least one track, c. recording an audio message into a digital recording device having a microprocessor and data storage, d. listening to said audio message stored on said data storage, e. uploading user visual data to said data storage, f. previewing said audio message and said prerecorded music, g. downloading said audio message from said data storage onto said digital recording medium, h. downloading said visual data from said data storage to said digital recording medium, i. merging at least one of said audio message with and said visual data with said prerecorded music to enable a listener to simultaneously hear said music, and hear said audio message or see said visual data.

14. The method of claim 13 further comprising the step of merge said audio message, said prerecorded music and said visual data.

15. The method of claim 13 further comprising the step of reviewing said audio message, said prerecorded music and said visual data prior to downloading onto said digital recording medium.

* * * * *